US011637412B2

(12) United States Patent
Mishima

(10) Patent No.: US 11,637,412 B2
(45) Date of Patent: Apr. 25, 2023

(54) SPARK PLUG

(71) Applicant: NGK SPARK PLUG CO., LTD., Nagoya (JP)

(72) Inventor: Daisuke Mishima, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 17/789,909

(22) PCT Filed: May 21, 2021

(86) PCT No.: PCT/JP2021/019354
§ 371 (c)(1),
(2) Date: Jun. 29, 2022

(87) PCT Pub. No.: WO2022/030072
PCT Pub. Date: Feb. 10, 2022

(65) Prior Publication Data

US 2023/0062977 A1 Mar. 2, 2023

(30) Foreign Application Priority Data

Aug. 4, 2020 (JP) ..... JP2020-132295

(51) Int. Cl.
*H01T 13/54* (2006.01)
*H01T 13/02* (2006.01)
*H01T 13/32* (2006.01)

(52) U.S. Cl.
CPC ..... *H01T 13/54* (2013.01); *H01T 13/02* (2013.01); *H01T 13/32* (2013.01)

(58) Field of Classification Search
CPC ..... H01T 13/54; H01T 13/32
(Continued)

(56) References Cited

U.S. PATENT DOCUMENTS 8,659,216 B2 2/2014 Below et al.
10,714,908 B1 * 7/2020 Gozawa ..... H01T 13/39
(Continued)

FOREIGN PATENT DOCUMENTS

JP 51-114540 U 9/1976
JP 2005-166298 A 6/2005
(Continued)

OTHER PUBLICATIONS

International Search Report for PCT/JP2021/019354 dated Jul. 27, 2021.

*Primary Examiner* — Christopher M Raabe
(74) *Attorney, Agent, or Firm* — Sughrue Mion, PLLC

(57) ABSTRACT

The spark plug includes: an insulator having an axial hole extending in an axial direction; a center electrode disposed at a front end in the axial direction of the axial hole and having a front end portion that protrudes from a front side of the axial hole; a tubular metal shell holding the insulator; and a ground electrode having one end portion that is fixed to a through hole provided in the metal shell, the ground electrode having another end portion that forms a discharge gap between the other end portion and the front end portion of the center electrode. The through hole extends toward the front side in the axial direction, in a direction from an outer peripheral surface toward an inner peripheral surface of the metal shell. The one end portion is located on a rear side relative to the other end portion in the axial direction.

4 Claims, 4 Drawing Sheets

(58) Field of Classification Search
USPC ..... 313/118
See application file for complete search history.

(56) References Cited

U.S. PATENT DOCUMENTS

| | | | | |
|---|---|---|---|---|
| 10,770,868 | B1 * | 9/2020 | Gozawa | H01T 13/20 |
| 10,944,244 | B2 * | 3/2021 | Ban | H01T 13/54 |
| 11,424,600 | B1 * | 8/2022 | Gozawa | H01T 13/54 |
| 11,431,155 | B2 * | 8/2022 | Ban | H01T 13/54 |
| 11,456,578 | B2 * | 9/2022 | Saito | H01T 13/20 |
| 2013/0099652 | A1 | 4/2013 | Below et al. | |
| 2020/0287358 | A1 * | 9/2020 | Gozawa | H01T 13/16 |

FOREIGN PATENT DOCUMENTS

| | | | |
|---|---|---|---|
| JP | 2013-089598 | A | 5/2013 |
| JP | 2019-046660 | A | 3/2019 |

* cited by examiner

SPARK PLUG

CROSS REFERENCE TO RELATED APPLICATIONS

This application is a National Stage of International Application No. PCT/JP2021/019354 filed May 21, 2021, claiming priority based on Japanese Patent Application No. 2020-132295 filed Aug. 4, 2020.

TECHNICAL FIELD

The present disclosure relates to a spark plug.

BACKGROUND ART

As an ignition spark plug used for an internal combustion engine, a spark plug that is mounted on an engine head and that causes spark discharge between a front end of a center electrode and a ground electrode is known (for example, Patent Document 1). In the spark plug described in Patent Document 1, a metal shell has a through hole formed to penetrate the metal shell in a thickness direction, and the ground electrode which is rod-shaped and which extends along a radial direction is press-fitted to the through hole.

PRIOR ART DOCUMENT

Patent Document

Patent Document 1: Japanese Patent Application Laid-Open (kokai) No. 2019-046660

SUMMARY OF THE INVENTION

Problem to be Solved by the Invention

In the spark plug described in Patent Document 1, the ground electrode enters a high-temperature state owing to combustion of air-fuel mixture, and thus pre-ignition might originate from the ground electrode. In view of this, technologies that enable inhibition of excessive increase in the temperature of a ground electrode to inhibit occurrence of pre-ignition have been required for spark plugs in which a ground electrode is inserted in a through hole formed in a metal shell.

Means for Solving the Problem

The present disclosure can be embodied in the following modes.

(1) According to an aspect of the present disclosure, a spark plug is provided. The spark plug includes: an insulator in which an axial hole extending in an axial line direction is formed; a center electrode disposed at a front end in the axial line direction of the axial hole and having a front end portion that protrudes from a front side of the axial hole; a tubular metal shell holding the insulator; and a ground electrode having one end portion that is fixed to a through hole provided in the metal shell, the ground electrode further having another end portion that forms a discharge gap between the other end portion and the front end portion of the center electrode. The through hole extends toward the front side in the axial line direction, in a direction from an outer peripheral surface toward an inner peripheral surface of the metal shell. The one end portion is located on a rear side relative to the other end portion in the axial line direction. In the spark plug of this aspect, the through hole provided in the metal shell extends toward the front side in the axial line direction, in the direction from the outer peripheral surface toward the inner peripheral surface of the metal shell, and the one end portion of the ground electrode is located on the rear side relative to the other end portion thereof in the axial line direction. Consequently, the one end portion of the ground electrode can be located close to an engine head. In general, the temperature of an engine head is lower than the temperature of the ground electrode. Thus, if the one end portion of the ground electrode is located close to an engine head, the heat dissipation property of the ground electrode can be improved. This makes it possible to inhibit excessive increase in the temperature of the ground electrode which enters a high-temperature state by being exposed to combustion of air-fuel mixture. Therefore, pre-ignition can be inhibited from originating from the ground electrode. That is, excessive increase in the temperature of the ground electrode is inhibited, whereby occurrence of pre-ignition can be inhibited.

(2) In the spark plug of the above aspect, a rear end of an opening, at the outer peripheral surface of the metal shell, of the through hole may be located on the rear side relative to a front end of the insulator in the axial line direction. In the spark plug of this aspect, the rear end of the opening, at the outer peripheral surface of the metal shell, of the through hole is located on the rear side relative to the front end of the insulator in the axial line direction. Consequently, the one end portion of the ground electrode can be located on a further rear side in the axial line direction. As a result, the one end portion of the ground electrode can be located closer to the engine head. Thus, excessive increase in the temperature of the ground electrode can be further inhibited, whereby occurrence of pre-ignition can be further inhibited.

(3) In the spark plug of the above aspect, the ground electrode may be provided to extend so as to approach the axial line, in a direction from the one end portion toward the other end portion, and the front end portion of the center electrode may have a parallel surface substantially parallel to an extension-provision direction of the ground electrode and form the discharge gap between the parallel surface and the other end portion. In the spark plug of this aspect, the front end portion of the center electrode has the parallel surface substantially parallel to the extension-provision direction of the ground electrode and forms the discharge gap between the parallel surface and the other end portion. Consequently, spark discharge can be caused between two surfaces parallel to each other. Thus, the position of the origin of spark discharge can be inhibited from concentrating on one spot, whereby the other end portion of the ground electrode can be inhibited from being abraded owing to spark discharge. As a result, a dimension of the discharge gap can be inhibited from changing in association with use of the spark plug, whereby the lifespan of the spark plug can be elongated.

The present invention can be embodied in various aspects and can be embodied in, for example, aspects such as a manufacturing method for the spark plug and an engine head on which the spark plug is mounted.

MODES FOR CARRYING OUT THE INVENTION

A. First Embodiment

Figure 1:
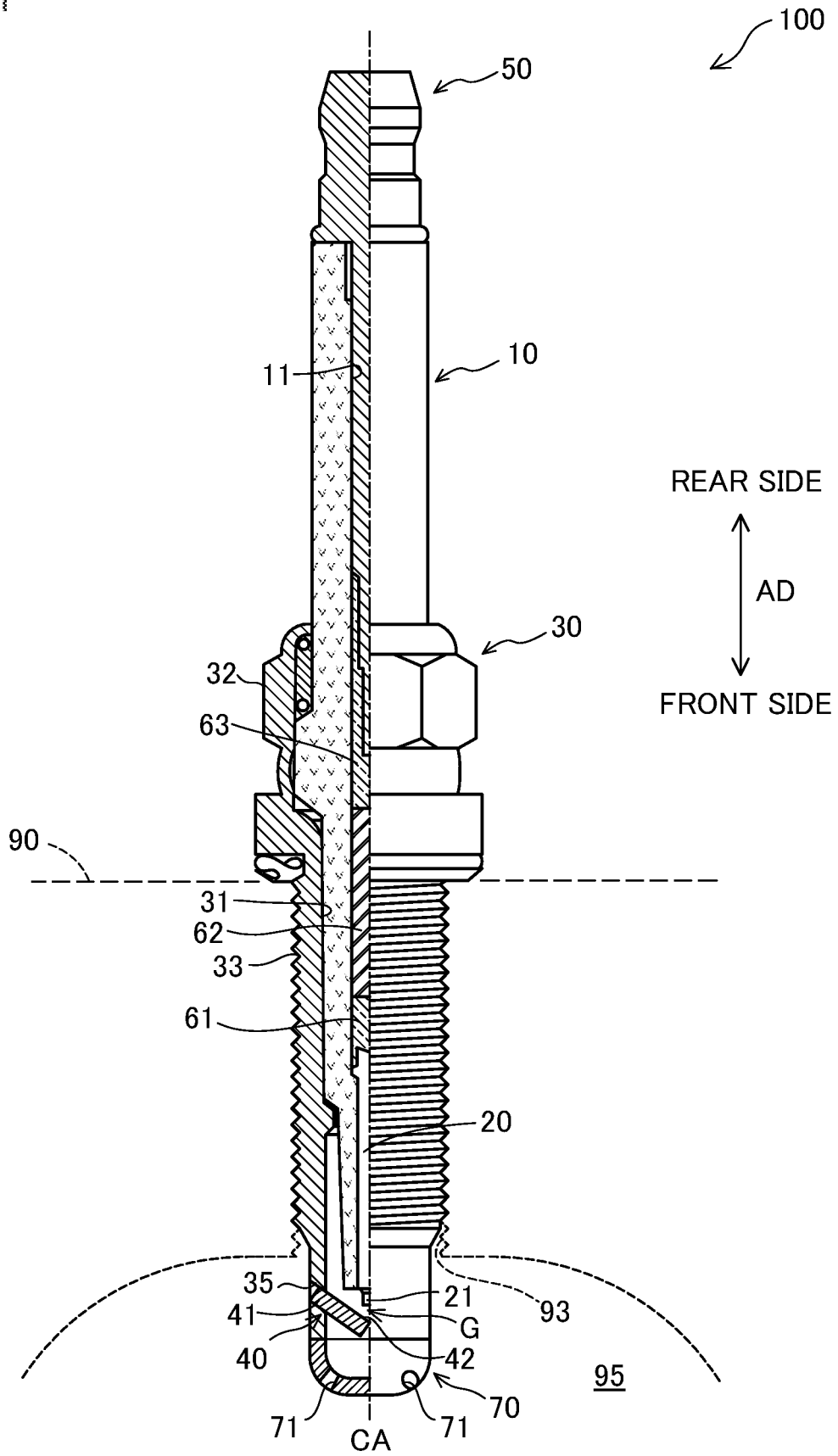
FIG. 1 Partial cross-sectional view showing a schematic configuration of a spark plug.

FIG. 1 is a partial cross-sectional view showing a schematic configuration of a spark plug 100 according to an embodiment of the present disclosure. In FIG. 1, the external appearance shape of the spark plug 100 is shown on the right side of the drawing sheet, and the cross-sectional shape of the spark plug 100 is shown on the left side of the drawing sheet, with an axial line CA as the axis of the spark plug 100 being the boundary between the left and right sides. In the following description, the lower side of FIG. 1 (the side on which a ground electrode 40 described later is disposed) along the axial line CA is referred to as a front side, the upper side of FIG. 1 (the side on which a metal terminal 50 described later is disposed) along the axial line CA is referred to as a rear side, and a direction along the axial line CA is referred to as an axial line direction AD. In FIG. 1, an engine head 90 on which the spark plug 100 is mounted is indicated by a broken line for the convenience of description. In general, the engine head 90 is provided with a coolant flow path (not shown) through which a coolant is circulated. The spark plug 100 is mounted on the engine head 90 such that a front end portion of the spark plug 100 is exposed in a combustion chamber 95. The spark plug 100 according to the present embodiment is configured as a pre-chamber plug in which an auxiliary combustion chamber 96 described later is formed.

The spark plug 100 includes an insulator 10, a center electrode 20, a metal shell 30, the ground electrode 40, the metal terminal 50, and a cover 70. The axial line CA of the spark plug 100 coincides with the axial line of each of members which are the insulator 10, the center electrode 20, the metal shell 30, the metal terminal 50, and the cover 70.

The insulator 10 has an external appearance shape that is substantially in the form of a tube in which an axial hole 11 extending in the axial line direction AD is formed. In the axial hole 11, a part of the center electrode 20 is disposed on the front side, and a part of the metal terminal 50 is disposed on the rear side. The insulator 10 holds the center electrode 20 inside the axial hole 11. The insulator 10 has: a front-side portion accommodated in an axial hole 31 of the metal shell 30 described later; and a rear-side portion exposed from the axial hole 31. The insulator 10 is implemented by a ceramic insulator formed by firing a ceramic material such as alumina.

The center electrode 20 is a rod-shaped electrode extending along the axial line direction AD. A front end portion 21 of the center electrode 20 protrudes from the front side of the axial hole 11. On the front end portion 21, for example, a noble metal tip formed from an iridium alloy or the like may be joined.

In the axial hole 11 of the insulator 10, a front-side seal material 61, a resistor 62, and a rear-side seal material 63 are disposed in this order from the front side to the rear side, between the center electrode 20 and the metal terminal 50. Therefore, the center electrode 20 is electrically connected on the rear side to the metal terminal 50 via the front-side seal material 61, the resistor 62, and the rear-side seal material 63.

The resistor 62 is formed from materials that are a ceramic powder, an electrically conductive material, and glass. The resistor 62 functions as an electric resistance between the metal terminal 50 and the center electrode 20, to inhibit generation of noise when spark discharge is caused. Each of the front-side seal material 61 and the rear-side seal material 63 is formed from a material that is an electrically conductive glass powder. In the present embodiment, each of the front-side seal material 61 and the rear-side seal material 63 is formed from a material that is a powder obtained by mixing copper powder and calcium borosilicate glass powder.

The metal shell 30 has an external appearance shape that is substantially in the form of a tube in which the axial hole 31 is formed along the axial line direction AD. The metal shell 30 holds the insulator 10 inside the axial hole 31. The metal shell 30 is, for example, formed from low-carbon steel and entirely plated with nickel, zinc, or the like. A tool engagement portion 32 and an external thread portion 33 are formed on the outer periphery of the metal shell 30. The tool engagement portion 32 is engaged with a tool (not shown) when the spark plug 100 is mounted on the engine head 90. The external thread portion 33 has a thread ridge formed on the outer peripheral surface thereof at a front end portion of the metal shell 30 and is screwed into an internal thread portion 93 of the engine head 90.

Figure 2:
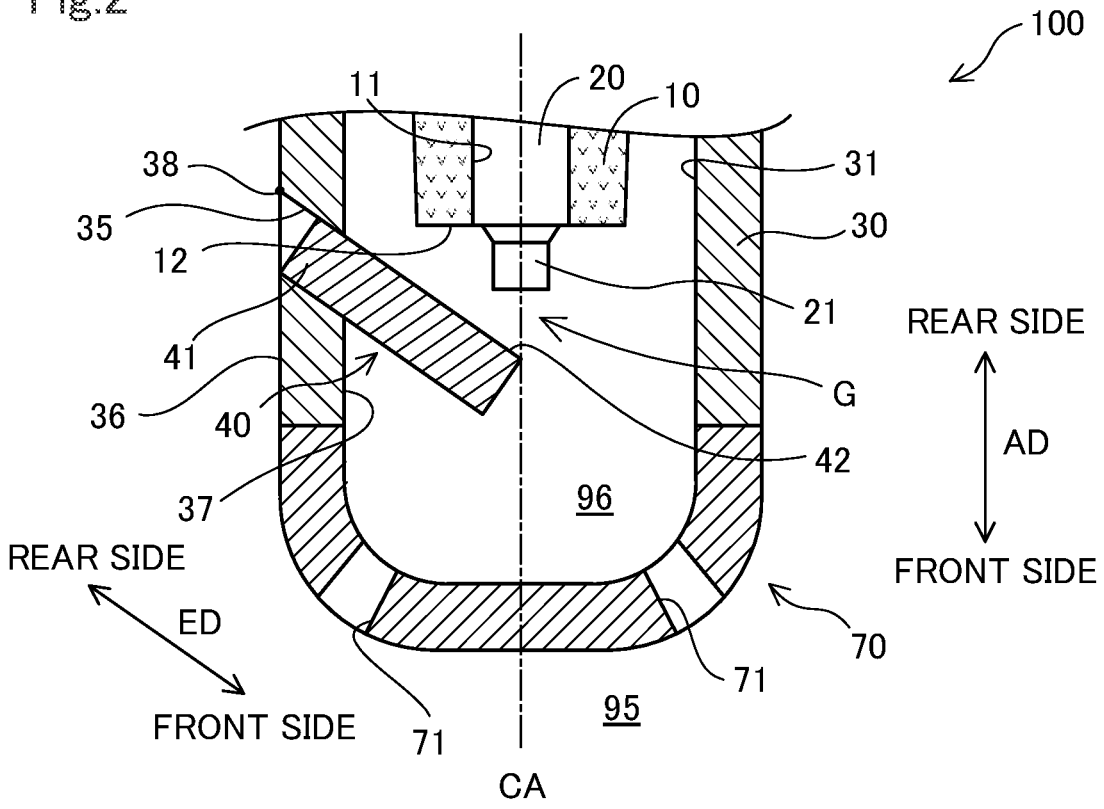
FIG. 2 Cross-sectional view schematically showing a configuration of a major part of the spark plug.

FIG. 2 is a cross-sectional view schematically showing a configuration of a major part of the spark plug 100. In FIG. 2, a cross section at and around a front end in the axial line direction AD of the spark plug 100 is shown in an enlarged manner. The cover 70 described later is fixed to a front end in the axial line direction AD of the metal shell 30. A front-side end portion in the axial line direction AD of the metal shell 30 has a through hole 35 formed to penetrate the metal shell 30 over the sheet thickness thereof. That is, through the through hole 35, an outer peripheral surface 36 and an inner peripheral surface 37 of the metal shell 30 are in communication with each other. The through hole 35 extends toward the front side in the axial line direction AD, in a direction from the outer peripheral surface 36 toward the inner peripheral surface 37 of the metal shell 30. In other words, the through hole 35 is formed to extend from the rear side toward the front side in the axial line direction AD, in a direction from an outer side toward an inner side in the radial direction of the metal shell 30. In the present embodiment, a rear end 38 of an opening, at the outer peripheral surface 36 of the metal shell 30, of the through hole 35 is located on the rear side relative to a front end 12 of the insulator 10 in the axial line direction AD. The ground electrode 40 is inserted and fixed to the through hole 35.

The ground electrode 40 is formed as a rod-shaped metal member and disposed so as to face the front end portion 21 of the center electrode 20. The ground electrode 40 in the present embodiment is formed from a nickel alloy containing nickel as a main component in the same manner as the center electrode 20. The ground electrode 40 is provided to extend from the rear side toward the front side in the axial line direction AD, in the direction from the outer side toward the inner side in the radial direction of the spark plug 100. In the following description, the direction in which the ground electrode 40 is provided to extend is referred to also as an extension-provision direction ED.

One end portion 41 of the ground electrode 40 is fixed to the through hole 35 provided in the metal shell 30. Another end portion 42 of the ground electrode 40 forms a discharge gap G for spark discharge, between the other end portion 42 and the front end portion 21 of the center electrode 20. The one end portion 41 is located on the rear side relative to the other end portion 42 in the axial line direction AD. The one end portion 41 is located on the rear side relative to the other end portion 42 in the extension-provision direction ED.

In the present embodiment, the ground electrode 40 is fixed by being press-fitted to the through hole 35 from the outer side in the radial direction of the spark plug 100. Alternatively, the ground electrode 40 may be fixed to the through hole 35 through an arbitrarily-selected means such as welding, instead of press-fitting or in addition to press-fitting. Further, the ground electrode 40 may be inserted in and fixed to the through hole 35 from the inner side in the radial direction of the spark plug 100.

As shown in FIG. 1, the metal terminal 50 is provided at a rear-side end portion of the spark plug 100. The front side of the metal terminal 50 is accommodated in the axial hole 11 of the insulator 10, and the rear side of the metal terminal 50 is exposed from the axial hole 11. A high-voltage cable (not shown) is connected to the metal terminal 50, and high voltage is applied to the metal terminal 50. The application of high voltage causes spark discharge in the discharge gap G. The spark caused in the discharge gap G ignites air-fuel mixture.

The cover 70 has an external appearance shape in the form of a tube with a bottom and is fixed to the front end in the axial line direction AD of the metal shell 30. The cover 70 forms the auxiliary combustion chamber 96 by covering, from the front side in the axial line direction AD, the discharge gap G formed by the front end portion 21 of the center electrode 20 and the other end portion 42 of the ground electrode 40. That is, the cover 70 forms therein the auxiliary combustion chamber 96. The auxiliary combustion chamber 96 in the present embodiment is a space enclosed by the insulator 10, the front end portion 21 of the center electrode 20, the metal shell 30, and the cover 70. In the present embodiment, the cover 70 is fixed by being welded to the front end of the metal shell 30. However, the means for the fixation is not limited to welding, and, for example, the cover 70 may be fixed to the metal shell 30 through an arbitrarily-selected means such as press-fitting or threaded engagement.

As shown in FIG. 2, the cover 70 has a plurality of ejection holes 71 formed to penetrate the cover 70 over the sheet thickness thereof. Therefore, through each ejection hole 71, the combustion chamber 95 and the auxiliary combustion chamber 96 are in communication with each other. Air-fuel mixture inside the combustion chamber 95 flows into the auxiliary combustion chamber 96 through the ejection hole 71 and is ignited by spark caused in the discharge gap G inside the auxiliary combustion chamber 96. Flame generated at the time of ignition is ejected to the combustion chamber 95 through the ejection hole 71.

In the above-described spark plug 100 according to the present embodiment, the through hole 35 formed in the metal shell 30 extends toward the front side in the axial line direction AD, in the direction from the outer peripheral surface 36 toward the inner peripheral surface 37 of the metal shell 30, and the one end portion 41 of the ground electrode 40 is located on the rear side relative to the other end portion 42 thereof in the axial line direction AD. Consequently, the one end portion 41 of the ground electrode 40 fixed to the through hole 35 can be located close to the engine head 90. Here, in general, the engine head 90 is provided with a coolant flow path, and the temperature of the engine head 90 tends to be lower than the temperature of the ground electrode. Thus, if the one end portion 41 of the ground electrode 40 is located close to the engine head 90, the heat dissipation property of the ground electrode 40 can be improved. In this manner, it is possible to inhibit excessive increase in the temperature of the ground electrode 40 which enters a high-temperature state by being exposed to combustion of air-fuel mixture. Therefore, pre-ignition can be inhibited from originating from the ground electrode 40. That is, excessive increase in the temperature of the ground electrode 40 is inhibited, whereby occurrence of pre-ignition can be inhibited.

Further, the rear end 38 of the opening, at the outer peripheral surface 36 of the metal shell 30, of the through hole 35 is located on the rear side relative to the front end 12 of the insulator 10 in the axial line direction AD. Consequently, the one end portion 41 of the ground electrode 40 can be located on a further rear side in the axial line direction AD. Thus, the one end portion 41 of the ground electrode 40 can be located closer to the engine head 90. As a result, excessive increase in the temperature of the ground electrode 40 can be further inhibited, whereby occurrence of pre-ignition can be further inhibited.

Further, the ground electrode 40 is fixed by being press-fitted to the through hole 35 provided in the metal shell 30. Consequently, a part in which the coefficient of thermal conductivity is locally low can be inhibited from being generated in a welded portion as compared to a configuration in which a ground electrode having a bent external appearance shape is welded to a front end surface of a metal shell. As a result, the heat dissipation property of the ground electrode 40 can be improved. Therefore, occurrence of pre-ignition due to increase in the temperature of the ground electrode 40 can be further inhibited.

Further, the spark plug 100 according to the present embodiment is configured as a pre-chamber plug in which the auxiliary combustion chamber 96 is formed. In general, in a pre-chamber plug, the volume and the shape of the auxiliary combustion chamber 96 greatly influences ejection of flame to the combustion chamber 95. However, in the spark plug 100 according to the present embodiment, since the ground electrode 40 is provided to extend such that the one end portion 41 is located on the rear side relative to the other end portion 42 in the axial line direction AD, excessive increase in the temperature of the ground electrode 40 is inhibited. Therefore, increase in the temperature of the ground electrode 40 can be inhibited without significantly changing the volume, the shape, and the like of the auxiliary combustion chamber 96.

B. Comparative Example

Figure 3:
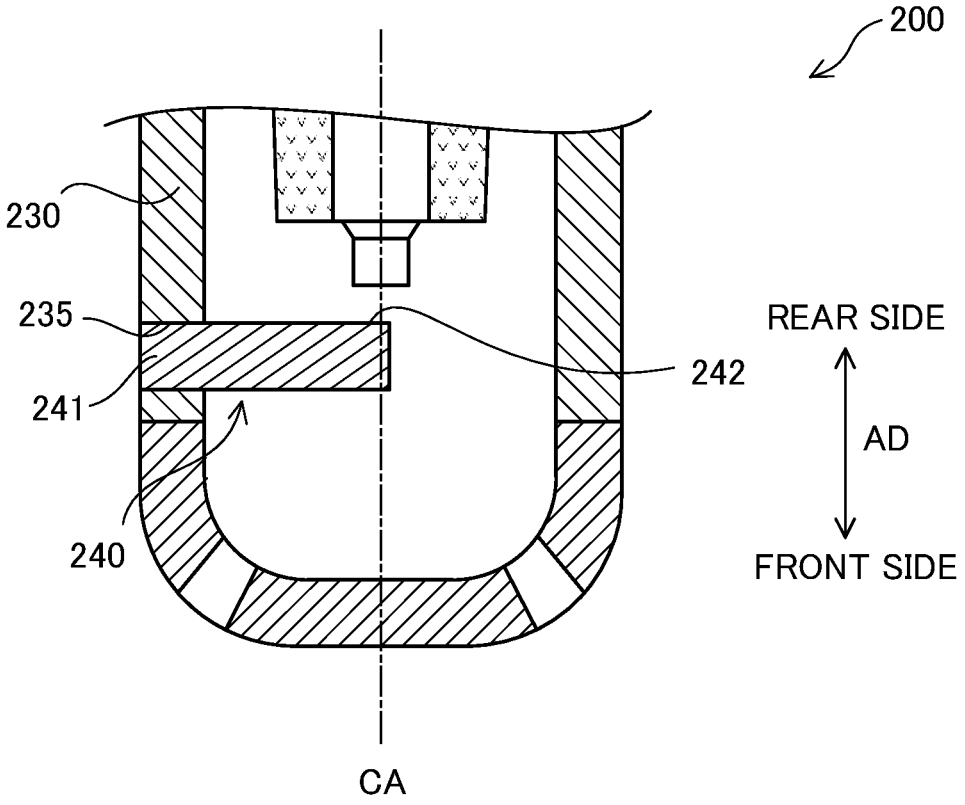
FIG. 3 Cross-sectional view schematically showing a configuration of a major part of a spark plug in a comparative example.

FIG. 3 is a cross-sectional view schematically showing a configuration of a major part of a spark plug 200 in a comparative example. In the spark plug 200 in the comparative example, a through hole 235 extends along the radial direction of a metal shell 230, and a ground electrode 240 is provided to extend in a direction perpendicular to the axial line direction AD. That is, the positions in axial line direction AD of one end portion 241 and another end portion 242 of the ground electrode 240 are equal to each other.

In the spark plug 200 in the comparative example, the position of the one end portion 241 of the ground electrode 240 is far from the position of the engine head. Therefore, heat dissipation from the ground electrode 240 insufficiently occurs in the spark plug 200 in the comparative example. As a result, the temperature of the ground electrode 240 increases, whereby pre-ignition might originate therefrom.

In contrast, in the above spark plug 100 according to the first embodiment shown in FIG. 2, the one end portion 41 of the ground electrode 40 is located on the rear side relative to the other end portion 42 thereof in the axial line direction AD. Consequently, the one end portion 41 can be located close to the engine head 90 provided with the coolant flow path. Thus, excessive increase in the temperature of the ground electrode 40 can be inhibited, whereby pre-ignition can be inhibited from originating from the ground electrode 40. As a result, occurrence of pre-ignition can be inhibited.

C. Second Embodiment

Figure 4:
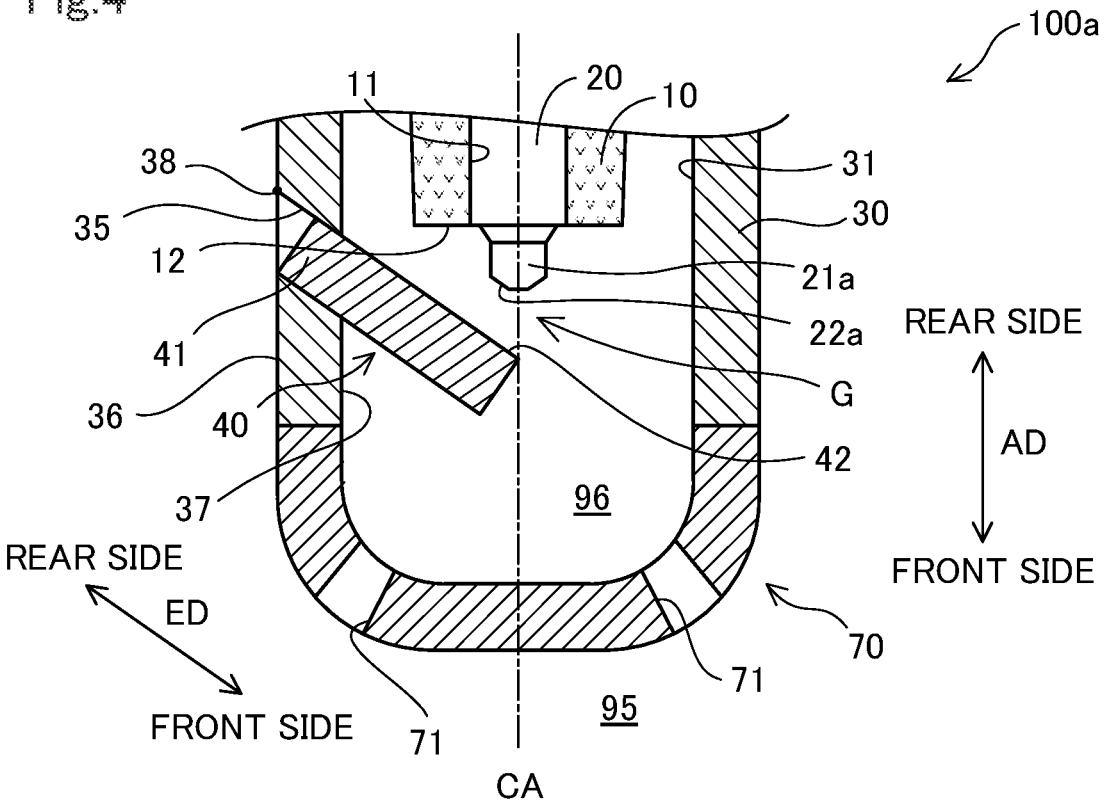
FIG. 4 Cross-sectional view schematically showing a configuration of a major part of a spark plug according to a second embodiment.

FIG. 4 is a cross-sectional view schematically showing a configuration of a major part of a spark plug 100*a* according to a second embodiment. The spark plug 100*a* according to the second embodiment is different from the spark plug 100 according to the first embodiment in terms of the shape of a front end portion 21*a* of the center electrode 20. The other components are the same as those of the spark plug 100 according to the first embodiment. Thus, the same components are denoted by the same reference numerals, and detailed description thereof is omitted.

The front end portion 21*a* of the center electrode 20 has a parallel surface 22*a* substantially parallel to the extension-provision direction ED of the ground electrode 40. Consequently, the front end portion 21*a* of the center electrode 20 has a form obtained by chamfering the corner of the front end in the axial line direction AD. In the present embodiment, the phrase "substantially parallel to the extension-provision direction ED" means being parallel to the extension-provision direction ED or intersecting with the extension-provision direction ED at an angle of 15° or smaller. The front end portion 21*a* forms the discharge gap G between the parallel surface 22*a* and the other end portion 42 of the ground electrode 40. The parallel surface 22*a* in the present embodiment is formed over the entire periphery of the front end portion 21*a* of the center electrode 20. However, the parallel surface 22*a* is not limited, in the position thereof, to the entire periphery and may be formed at a part in a peripheral direction including a portion that faces the other end portion 42. The front end portion 21*a* may have a form in which a noble metal tip provided at a front end of the center electrode 20 is included. In this form, the parallel surface 22*a* may be a surface formed on the noble metal tip.

The above-described spark plug 100*a* according to the second embodiment exhibits the same advantageous effects as those in the first embodiment. In addition, since the front end portion 21*a* of the center electrode 20 has the parallel surface 22*a* substantially parallel to the extension-provision direction ED of the ground electrode 40 and forms the discharge gap G between the parallel surface 22*a* and the other end portion 42 of the ground electrode 40, spark discharge can be caused between two surfaces parallel to each other. Thus, the position of the origin of spark discharge can be inhibited from concentrating on one spot, whereby the outer edge of the front end portion 21*a* of the center electrode 20 and the other end portion 42 of the ground electrode 40 can be inhibited from being abraded owing to spark discharge. As a result, a dimension of the discharge gap G can be inhibited from changing in association with use of the spark plug 100*a*. Therefore, the period during which an initial value of the discharge gap G is maintained can be inhibited from being shortened, whereby a malfunction at the time of ignition can be inhibited. As a result, the lifespan of the spark plug 100*a* can be elongated.

D. Other Embodiments

The configurations of the spark plugs 100 and 100*a* according to the above respective embodiments are merely examples and can be variously modified. For example, in each of the above embodiments, the rear end 38 of the opening of the through hole 35 is located on the rear side relative to the front end 12 of the insulator 10 in the axial line direction AD. However, the rear end 38 of the opening of the through hole 35 may be located on the front side relative to the front end 12 of the insulator 10 in the axial line direction AD, or the position in the axial line direction AD of the rear end 38 may be identical to that of the front end 12 of the insulator 10. Further, for example, although the spark plugs 100 and 100*a* according to the above respective embodiments are each configured as a pre-chamber plug, the spark plugs 100 and 100*a* may each be configured as an ignition plug in which the cover 70 is eliminated so that no auxiliary combustion chamber 96 is provided. With these configurations as well, the same advantageous effects as those in the above embodiments are exhibited.

The present invention is not limited to the above embodiments and can be embodied in various configurations without departing from the gist of the present invention. For example, the technical features in the embodiments corresponding to the technical features in the respective modes described in the section "SUMMARY OF THE INVENTION" can be replaced or combined, as appropriate, to solve some or all of the foregoing problems or to achieve some or all of the foregoing advantageous effects. Further, technical features that are not described as being essential in the present specification, can be deleted as appropriate.

DESCRIPTION OF REFERENCE NUMERALS

10: insulator
11: axial hole
12: front end
20: center electrode
21, 21*a*: front end portion
22*a*: parallel surface
30: metal shell
31: axial hole
32: tool engagement portion
33: external thread portion
35: through hole
36: outer peripheral surface
37: inner peripheral surface
38: rear end
40: ground electrode
41: one end portion
42: another end portion
50: metal terminal
61: front-side seal material
62: resistor
63: rear-side seal material
70: cover
71: ejection hole
90: engine head
93: internal thread portion
95: combustion chamber
96: auxiliary combustion chamber
100, 100*a*: spark plug
200: spark plug

240: ground electrode
241: one end portion
242: another end portion
AD: axial line direction
CA: axial line
ED: extension-provision direction
G: discharge gap

The invention claimed is:

1. A spark plug comprising:

an insulator in which an axial hole extending in an axial line direction is formed;

a center electrode disposed at a front end in the axial line direction of the axial hole and having a front end portion that protrudes from a front side of the axial hole;

a tubular metal shell holding the insulator; and a ground electrode having one end portion that is fixed to a through hole provided in the metal shell, the ground electrode further having another end portion that forms a discharge gap between the other end portion and the front end portion of the center electrode, wherein the through hole extends toward the front side in the axial line direction, in a direction from an outer peripheral surface toward an inner peripheral surface of the metal shell, and the one end portion is located on a rear side relative to the other end portion in the axial line direction.

2. The spark plug according to claim 1, wherein a rear end of an opening, at the outer peripheral surface of the metal shell, of the through hole is located on the rear side relative to a front end of the insulator in the axial line direction.

3. The spark plug according to claim 1, wherein the ground electrode is provided to extend so as to approach the axial line, in a direction from the one end portion toward the other end portion, and the front end portion of the center electrode has a parallel surface substantially parallel to an extension-provision direction of the ground electrode and forms the discharge gap between the parallel surface and the other end portion.

4. The spark plug according to claim 2, wherein the ground electrode is provided to extend so as to approach the axial line, in a direction from the one end portion toward the other end portion, and the front end portion of the center electrode has a parallel surface substantially parallel to an extension-provision direction of the ground electrode and forms the discharge gap between the parallel surface and the other end portion.

* * * * *